US006042078A

United States Patent [19]

Donovan

[11] Patent Number: 6,042,078

[45] Date of Patent: Mar. 28, 2000

[54] WALL HANGER, MOUNTING KIT, AND METHOD

[76] Inventor: Charles A. Donovan, 1535 Green Acre Point, Oviedo, Fla. 32765

[21] Appl. No.: 09/027,024

[22] Filed: Feb. 20, 1998

Related U.S. Application Data

[60] Continuation-in-part of application No. 08/688,717, Jul. 31, 1996, abandoned, which is a division of application No. 08/226,968, Apr. 13, 1994, Pat. No. 5,542,641.

[51] Int. Cl.[7] ..... A47G 1/16

[52] U.S. Cl. ..... 248/547; 7/167; 81/44; 248/489; 248/493

[58] Field of Search ..... 248/544, 546, 248/547, 466, 475, 489, 497, 493; 30/366; 227/107; 81/44; 7/167

[56] References Cited

U.S. PATENT DOCUMENTS

| | | | |
|---|---|---|---|
| D. 33,497 | 11/1900 | Williams . | |
| 70,261 | 10/1867 | Quail | 7/167 |
| 233,295 | 10/1880 | Steinmeyer | 30/366 |
| 768,126 | 8/1904 | Huber | 30/366 |
| 1,272,696 | 7/1918 | Mock . | |
| 1,292,956 | 1/1919 | McConnal . | |
| 2,633,322 | 3/1953 | Barr . | |
| 2,783,799 | 3/1957 | Hart | 81/44 |
| 2,786,528 | 3/1957 | Wick | 30/366 |
| 3,995,821 | 12/1976 | Einhorn . | |
| 4,094,490 | 6/1978 | Einhorn . | |
| 4,249,763 | 2/1981 | Provencher et al. | 248/547 |
| 4,443,949 | 4/1984 | Newton | 248/498 |
| 4,739,961 | 4/1988 | Thomas . | |
| 4,883,247 | 11/1989 | Crandall | 248/489 X |
| 4,991,278 | 2/1991 | Hendrix | 81/44 X |
| 5,018,697 | 5/1991 | Treanor et al. . | |
| 5,069,412 | 12/1991 | Jacob . | |
| 5,638,566 | 6/1997 | Wu | 7/167 |

FOREIGN PATENT DOCUMENTS

| | | | |
|---|---|---|---|
| 1067111 | 6/1954 | France | 248/497 |
| 166155 | 3/1934 | Switzerland | 248/489 |
| 10113 | 5/1905 | United Kingdom | 248/493 |

*Primary Examiner*—Derek J. Berger
*Attorney, Agent, or Firm*—Allen, Dyer, Doppelt MIlbrath & Gilchrist, P.A.

[57] ABSTRACT

The wall hanger of the present invention is designed to minimize the damage done to a wall when hung thereon. The wall hanger has a plurality of narrow bores angling generally downward through which pleating pins may be inserted to anchor the wall hanger. The wall hanger additionally has a support member from which may be hung an object. The bores and support member are configured to maximize a proportion of gravitational stress transferred to the wall to relieve stress on the pins. A pilot tool is also disclosed that starts a hole in the wall through the bores in the hanger and then is used to push a pin through the bore, into the pretapped hole in the wall, and further into the wall until its head is flush with the hanger. A kit is provided that consists of a wall hanger and a mounting tool. In addition, a method is provided for mounting a wall hanger to a wall.

12 Claims, 4 Drawing Sheets

WALL HANGER, MOUNTING KIT, AND METHOD

CROSS-REFERENCE TO RELATED APPLICATIONS

This application is a continuation-in-part application of U.S. application 08/688,717, filed Jul. 31, 1996, which is a divisional of application Ser. No. 08/226,968, filed Apr. 13, 1994, now issued U.S. Pat. No. 5,542,641.

BACKGROUND OF THE INVENTION

1. Field of the Invention

The present invention relates to devices for mounting objects to a wall or a similar vertical surface, and, more particularly, to devices for affixing objects to a semipermeable surface such as drywall.

2. Description of Related Art

Various implements have been devised to hang objects from walls. Most such hangers have utilized screws, bolts, or nails, which typically must have a sufficiently large diameter to support the weight of the object. Thus most of these devices, when used on a semipermeable material such as drywall, will leave unsightly holes when removed and may even tear the drywall covering. Such holes also render it impossible to make minor adjustments to the position of the hanger, such as are frequently desired when attempting to level an object or to align one object with another. In addition, in the process of making the hole, wall material is lost, weakening the area of the wall where an object is to be hung. This problem is so severe in rental units and dormitories, for example, that walls must routinely be replaced every 7–10 years.

Locating an area to hang the object can also present a problem. For example, with previously known hangers it has been necessary to avoid particular wall locations in order to prevent hitting studs or beams behind the wall material with the nail, screw, or bolt.

Other hangers known in the art have an adhesive backing material. Typically such hangers cannot support much weight, and, if they fail, tear the wall surface or wallpaper to which they are applied.

The positioning of the elements of prior hangers has also not been optimal. Most hangers, for example, have the hook or protrusion located at the bottom of the hanger. When weight is applied to the device, a downward force is experienced, tending to pull the hanger downward, which in turn causes the nail, screw, or bolt to bend and/or to tear the wall. A horizontal distance between the point at which force is applied and the wall further introduces a torque, tending to pull the top of the hanger away from the wall, which can cause failure in the form of pulling the support out of (or away from in the case of an adhesive backing) the wall. Any of these failures can also, of course, damage the hanging object.

Previously known hangers have been made of opaque material. This has made it difficult to position an object precisely, as adjustments must be made for the location of the hanging element. Further, an imminent failure cannot be spotted, since the nail, bolt, or screw is hidden from view.

The methods and tools utilized to affix known hanging devices to a wall have not been satisfactory. For example, the tools used to drive the anchoring means of the devices, such as hammers, can also cause damage to the wall (or to the user).

Of the hanging devices that are known in the art, Mock (U.S. Pat No. 1,272,696) describes a picture hanger that comprises a double-pointed pin inserted into a wall at an angle to the horizontal. McConnal (U.S. Pat. No. 1,292,956) discloses a hanger that comprises a wall plate having a needle or pin projecting at an angle that can be pressed into a wall without marring the surface. An object hanger for drywall is described by Treanor et al. (U.S. Pat. No. 5,018,697) that utilizes a unitary straight pin pushed through an aperture in the hanger body at a 45 degree angle. Hanging devices are also disclosed by French patent 1,067,111, U.S. Pat. No. 2,783,799 to Hart, and U.S. Pat. No. 1,341,759 to Peterson.

SUMMARY OF THE INVENTION

It is accordingly an object of the present invention to provide a hanger that minimize damage done to a wall.

It is a further object to provide a hanger that utilizes affixing members of sufficiently small diameter to avoid making large holes in a wall.

It is an additional object to provide a hanger that is relocatable a small distance from an initial placement.

It is another object to provide a hanger that will absorb normal shock without failure.

It is yet a further object to provide a hanger that redistributes hung weight to the wall.

It is yet an additional object to provide a tool for use in mounting the wall hanger.

It is yet another object to provide a kit for affixing a hanger to a wall including the hanger and the mounting tool.

It is a further object to provide a method for hanging an object on a vertical surface such as a wall that minimizes the damage done to the vertical surface.

It is an additional object to provide a method for affixing a hanger to a vertical surface that also minimizes the damage done to the wall.

These and other objects are accomplished by the various aspects and embodiments of the present invention, among which is included a wall hanger, which has means for supporting the object to be hung. The hanger has a generally planar first side for interfacing with the wall, a second side generally opposed to the first side, a top edge, and a bottom. The hanger further has a plurality of narrow bores disposed adjacent the top edge, extending from the second side to the first side, and angling away from the top edge. Each bore is dimensioned to permit a narrow affixig means such as a pleating pin to pass through the bore.

The use of pleating pins has been found to be advantageous because a minimum amount of damage is done to a wall with their insertion and removal. It has been found that most types of walls, including but not limited to drywall, plaster, wood, and plaster, and all types of wall coverings, including but not limited to wallpaper and vinyl, are amenable to having the wall hanger of the present invention mounted thereto.

The hanger additionally has support means protruding from its second side. The support means is positioned a first distance from the top edge and a second distance greater than the first distance from the bottom. Such a positioning serves in use to translate a portion of the gravitational force exerted by a hung object into a force directed into the wall, which relieves the stress placed upon the pins.

A pilot tool is also provided as an additional aspect of the present invention. This tool, which is capable of starting holes in a semipermeable wall surface preparatory to inserting the pin through the hanger, has a pointed borer at one end and a handle at the other end. The borer is dimensioned for making holes in a wall after having passed through a bore of the wall hanger. The borer has a length dimensioned to start a hole in a wall sufficiently deep to permit an easy insertion of a pleating pin thereinto. The bore's handle has a first end, at which it is affixed to the borer, and a second end, which has an indentation therein dimensioned to surround the head of a pin for pushing the pin through a bore in the hanger, into a started hole, and further into the wall until the head is substantially flush with the hanger's second side.

A wall hanger kit is further provided that comprises a wall hanger and a mounting tool as described above.

The method for mounting an object on a wall using the wall hanger of the present invention comprises the steps of providing a wall hanger as described above, placing the wall hanger with the first side against a wall and the top edge facing generally upwards, pushing a boring tool through at least two bores to start a hole in the wall aligned with each bore, the hole being sufficiently long to enable a pleating pin to pass through the bore and into the wall, pushing a pleating pin into each bore, and mounting an object upon the support means.

The features that characterize the invention, both as to organization and method of operation, together with further objects and advantages thereof, will be better understood from the following description used in conjunction with the accompanying drawing. It is to be expressly understood that the drawing is for the purpose of illustration and description and are not intended as a definition of the limits of the invention. These and other objects attained, and advantages offered, by the present invention will become more fully apparent as the description that now follows is read in conjunction with the accompanying drawing.

BRIEF DESCRIPTION OF THE PREFERRED EMBODIMENTS

Figure 6A:
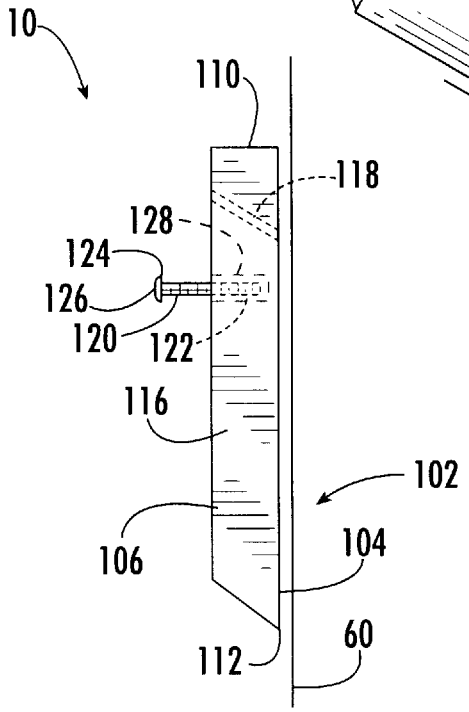
Figure 6B:
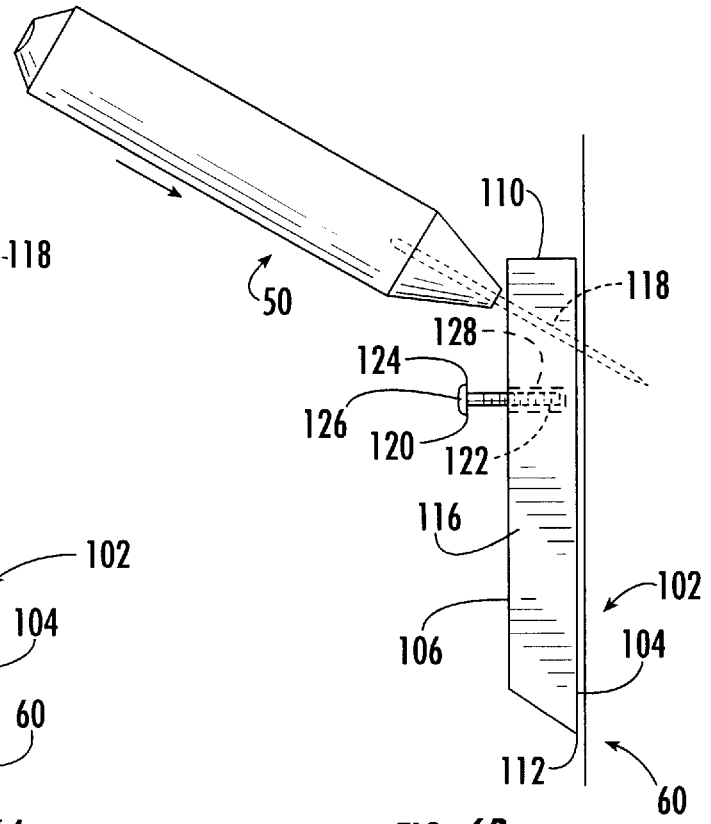
Figure 6C:
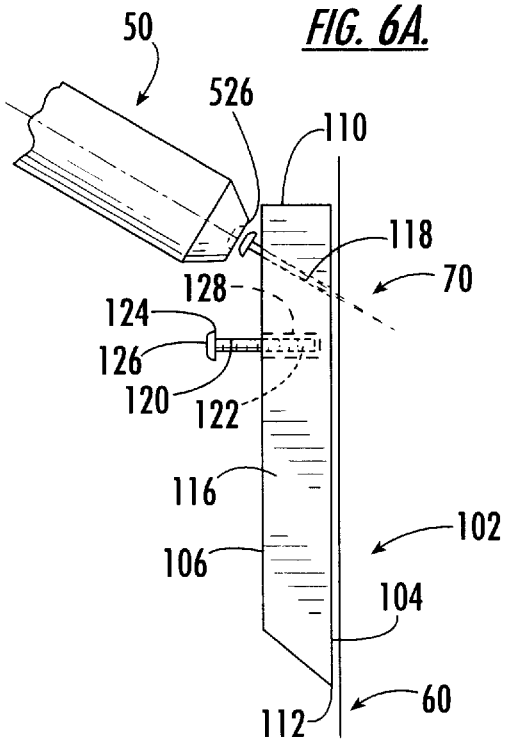
Figure 6D:
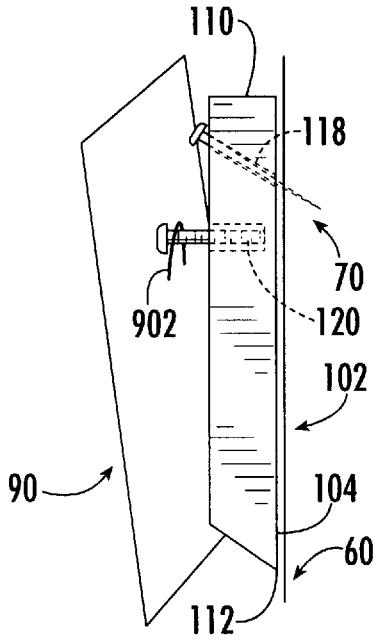

FIGS. 6A–D illustrates the method of mounting the wall hanger. In FIG. 6A the hanger is positioned again wall; in FIG. 6B the pilot tool is used to pretap a hole in the wall; in FIG. 6C the other end of the pilot tool is used to press a pleating pin into the pretapped hole. The steps of FIGS. 6A–C are repeated as many times as needed to insert a desired number of pins. In FIG. 6D an object is hung from the support member.

DETAILED DESCRIPTION OF THE PREFERRED EMBODIMENTS

A description of the preferred embodiments of the present invention will now be presented with reference to FIGS. 1–6D.

Figure 1:
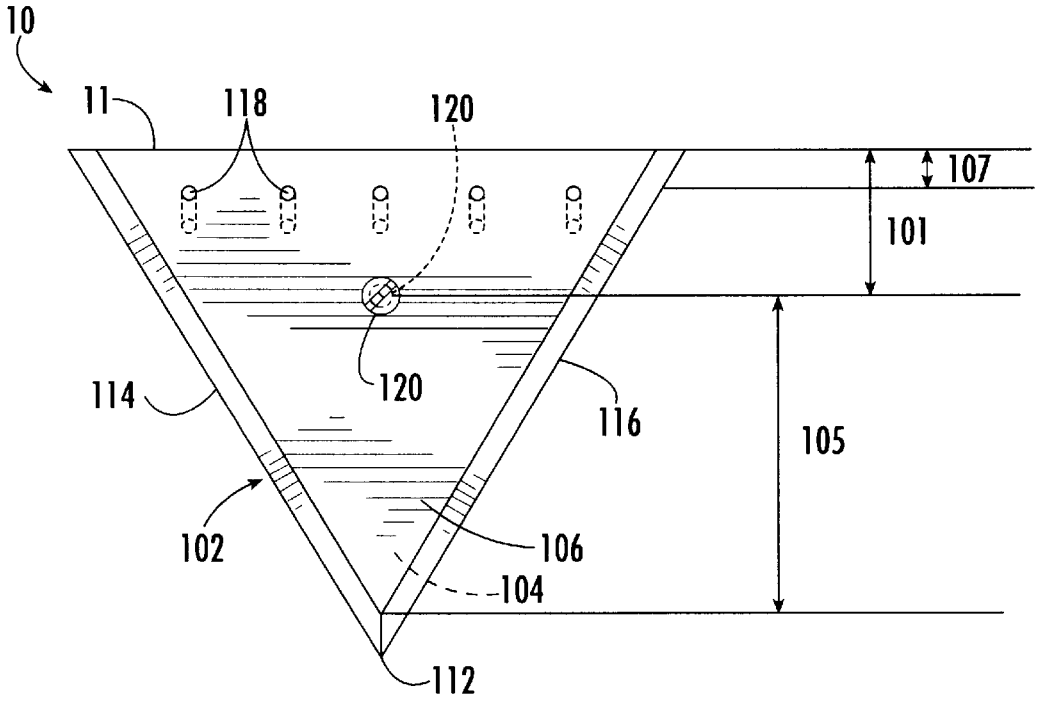
FIG. 1 is a front view of the picture hanger of the present invention.
Figure 2:
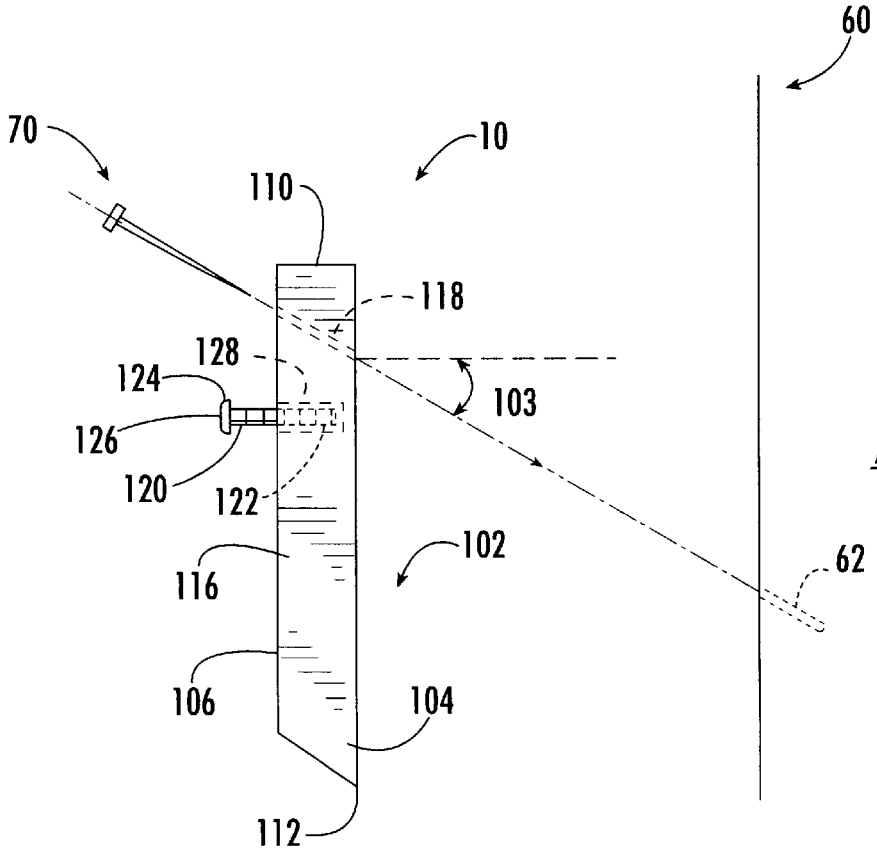
FIG. 2 is a side view of the picture hanger of FIG. 1.

In FIGS. 1 and 2 is shown a first embodiment of a wall hanger designed for minimizing damage to a wall. This embodiment is designed for use with objects such as pictures, and will be referred to generally by the reference numeral 10. It is to be understood, however, that any number of objects can be hung from the hanger 10, and that the invention is not intended to be limited thereto.

The wall hanger 10 of this embodiment has a generally equilateral triangular shape, although this is not intended as a limitation, as other shapes could be readily conceived by one of skill in the art. The hanger 10 is preferably made of a stiff, clear material, such as a plastic like acrylic or Lexan. The hanger 10 has a generally planar first side 104 for interfacing with a wall 60 and a generally planar second side 106 opposed to first side 104. Since this embodiment 10 is clear, determining the location for hanging is facilitated. Hanger 10 further has a top edge 110 along a first edge of the triangular shape and a bottom 112 defined by the point formed by the junction of the beveled second 114 and third 116 edges of the triangular shape. The edges' 114,116 bevels extend outward from the second side 106 to the first side 104.

Along the top edge 110 are disposed a plurality of narrow bores 118. Bores 118, in a preferred embodiment numbering five, extend in a direction away from top edge 110 from second side 106 to first side 104. Bores 118 are sufficiently narrow to permit a pleating pin 70 to pass therethrough and are sufficiently short to permit a pleating pin 70 to penetrate wall 60 when the first side 104 is placed against a wall 60. Bores 118 are located a distance 107 from top edge 110.

The pins 70 recommended for use with the present invention comprise #12 pleating pins for use in drywall and plaster walls and #8 pleating pins for use in wood and paneling. These pins 70 are advantageous because they are readily available to the consumer. Additionally, they are sufficiently narrow to minimize damage to any wall surface. When removed from drywall or wood, a small dab of paint or crayon will conceal the pinhole; for wall paper or cloth surface, wetting and smoothing over the hole will conceal the pinhole. This feature significantly distinguishes over previously known hangers, which have utilized larger-diameter nails or screws that damage the wall surface.

In a preferred embodiment, each bore has a diameter of 0.026±0.004 in., which has been found to prevent a pin 70 from bending unless a predetermined weight limit has been exceeded.

The bore angle 103 is preferably in a range of 20–30° from a normal to the first side 104. This angle range has been found advantageous because, if the predetermined weight limit is exceeded, the pins 70 will pull out of the wall 60 rather than tearing the wall material, which has been found to occur with an angle of 45° such as is known in previously disclosed hangers. In addition, this angle range has been found to maximize the amount of weight that can be supported safely. The 5-pin embodiment, for example, can support up to 50 pounds on drywall and 100 pounds on wood, approximately double that possible with an angle of 45°. (The higher the density of the wall surface, the greater the maximum weight able to be supported.) It is obvious to one of skill in the art that greater weight can be supported with embodiments having additional bores 118. The clear material of the preferred embodiment confers another advantage in that, if the weight limit is exceeded, the user can remove the object shortly after hanging and see that the pins 70 have begun to elongate the pinholes 62, which will indicate to the user that an additional hanger 10 or one having a greater weight-bearing rating should be used.

A further advantage of these particular pins 70 is their elasticity, which permits the pin/hanger combination to absorb normal vibrations to the wall rather than loosening their hold or slicing the wall material, which can occur with conventional hangers. It is believed that the pins' elasticity confers this feature, although this interpretation is not intended as a limitation.

Extending from the hanger's second side 106 is a support means upon which a desired object is hung. A critical feature of the invention is the positioning of the support means, which is a first distance 101 from the top edge 110 and a second distance 105 from the bottom 112 greater than the first distance 101. This positioning serves to translate a portion of the gravitational force exerted by a supported object into a force directed into the wall 60. Such a translation relieves stress on the pins 70 that have been placed through the bores 118 and into the wall 60. Tests have shown that an exemplary ratio of 3:8 for a first distance 101 to a second distance 105 permits a 50% force translation into the wall 60, although this ratio is not intended as a limitation. It has been shown that placing the support means at the bottom of a hanger, such as are known in the art, greatly reduces the weight-bearing limit, as the force is all directed upon the weight-bearing member(s).

A first embodiment of a support means of the picture hanger (FIGS. 1 and 2) comprises a screw 120 having a first end 122 press-fit into base 102 and a second end 124 having a screw head 126 for restraining a picture wire or the frame of a picture when the wire or frame has been hung upon screw 120.

Figure 3:
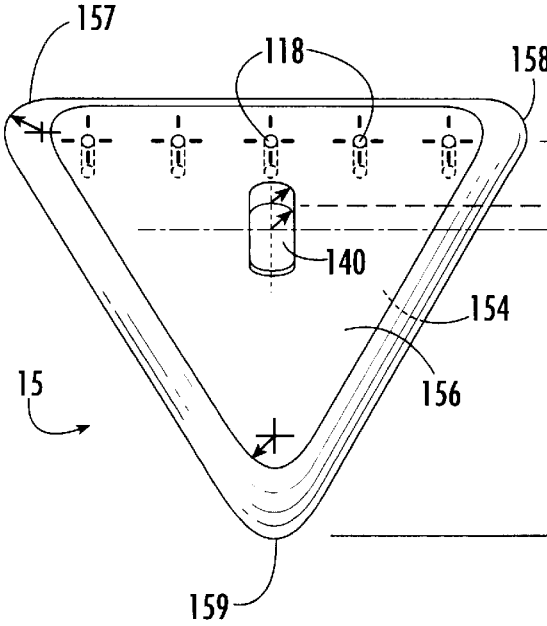
FIG. 3 is a front view of an alternate embodiment of the picture hanger.
Figure 4:
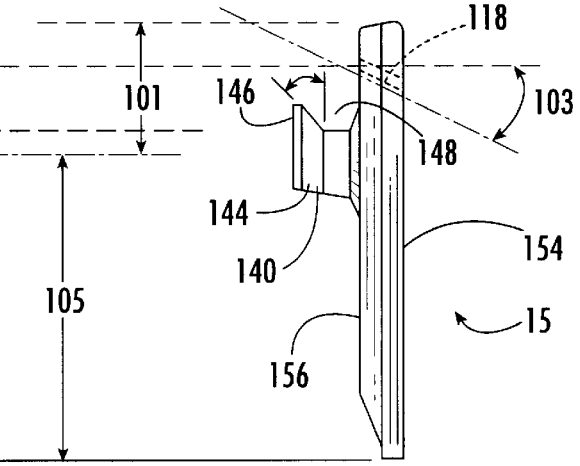
FIG. 4 is a side view of the picture hanger of FIG. 3.

An alternate embodiment of the triangular picture hanger is shown in FIGS. 3 and 4, indicated by the reference numeral 15. A difference between this embodiment and that discussed above 10 is that the support means comprises a molded hook 140 having a first end 142 integrally connected to second side 156 and a second end 144 having an upwardly extending portion 146 defining a valley 148 onto which a picture wire or the like may be hung and restrained by the upwardly extending portion 146.

An additional difference is that the corners 157–159 are rounded, providing a pleasing appearance and decreasing a chance of scraping the wall surface with a sharper corner.

In either hanger 10 or 15, it is preferable that the object to be hung be retained adjacent the second side 106, in order to minimize the moment exerted on the protrusion 120,140.

It may be appreciated by one skilled in the art that a virtually limitless any of embodiments of the wall hanger of the present invention are possible. For instance, a variation of picture hanger 10 could comprise a coat hanger, wherein the hook member would be elongated in order to support a coat. Yet a further embodiment is a mirror hanger, which would comprise a plurality of hangers similar to hanger 15, wherein the molded hook would be replaced by a raised ridge for supporting the mirror frame. Other potential embodiments, which are subsumed under the present wall hanger invention described herein, include hangers for shelves, kitchen racks, telephones, and lamps. It is important to note, however, that each embodiment must be designed with careful attention to the bore positions and angles, since these parameters determine the amount and distribution of weight that can be supported.

Figure 5A:
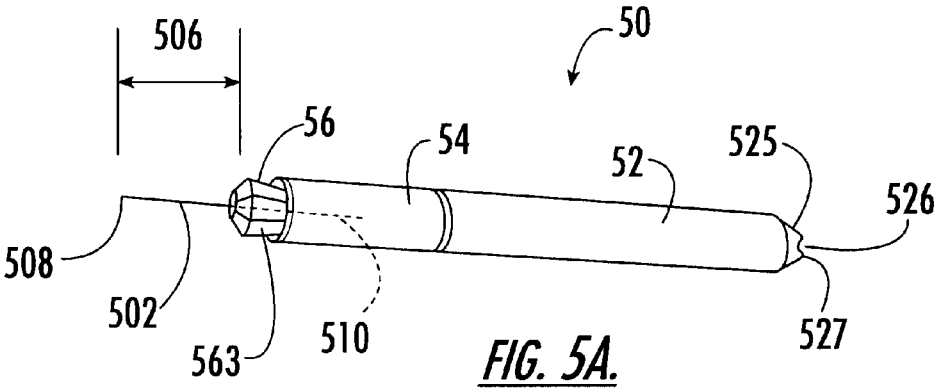
FIG. 5A is a side perspective view of an assembled pilot tool for use with the wall hanger of the present invention. The jaws are shown in the closed position, holding a needle.

In FIG. 5A is shown an assembled pilot tool 50 of the present invention that is used in affixing the hangers 10,15 of the present invention to a wall 60. Pilot tool 50 comprises a pointed borer affixed to a handle 504. Pointed borer, in a preferred embodiment comprises a removable needle 502, such as a #7 sewing needle, although this is not intended as a limitation. The needle 502 has a first pointed end 508 and a proximal portion 510 residing within handle 504, and is sufficiently sharp to start holes in a wall 60 after having passed through a bore 118 in the base of a wall hanger 10,15. The borer 502 has an exposed length 506 dimensioned to make a hole in a wall 60 sufficiently deep to start a hole for a pleating pin 70 when pleating pin 70 is pushed through the bore 118 and into wall 60.

The removable nature of the needle 502 permits the user to replace a needle if it becomes dull through use. This needle is dimensioned to fit through the angled bores 118 of the hanger 10,15. This needle 502 is stiffer than the pleating pin 70, and serves, when used to start a hole, to easily pierce wall material. In the case of drywall, the plaster is packed around the hole during the needle insertion process, achieving a higher density of plaster therearound, which actually aids in the hanging process by strengthening the region around the hole.

Figure 5B:
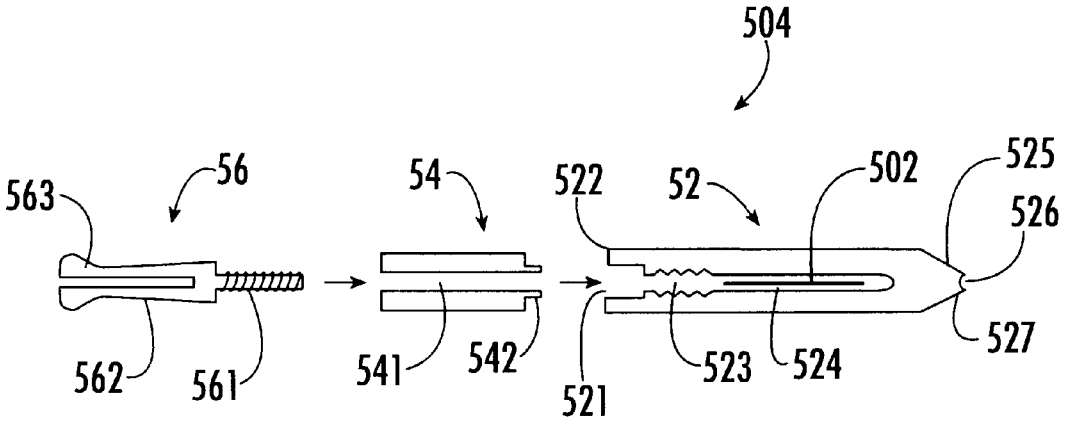
FIG. 5B is a side-sectional view of a disassembled pilot tool, with the jaws open, the proximal section having a hollow interior for housing a needle.

In this embodiment, the handle 504 comprises a first, proximal section 52, a hollow second, central section 54, and a gripping, distal section 56, all separable from each other as shown in FIG. 5B. First section 52, the most proximal portion of the handle 504, has an opening 521 at the distal end 522 leading to an interior chamber that has a threaded distal portion 523 and a generally cylindrical storage portion 524 for housing a needle 502 therein when not in use for safety and also for housing spare needles 502. First section 52 further has a tapered portion 525 leading to a proximal end 527, tapering in a proximal direction toward an indentation 526 that is dimensioned to surround the head 702 of a pin 70 and to push the pin 70 through a bore in the hanger and into a wall 60.

Second section 54 is a generally cylindrical member having a generally smooth bore 541 therethrough and a lip 542 at the proximal end that is dimensioned for insertion into the first section's distal opening 521.

The gripping section 56 has a threaded proximal portion 561 is sufficiently long and thin to pass through the second section's bore 541 and to proceed into the first section's threaded portion 523, with which it is screwingly engagable. The distal portion 562 has a plurality, here four, of jaws 563 that are biased to separate from each other sufficiently to permit the insertion of the needle's proximal portion 510 therebetween. Jaws 563 are movable between a closed position (FIG. 5A) wherein the needle's proximal portion 510 is closely held therewithin and an open position (FIG. 5B) wherein the needle's proximal portion 510 is removable therefrom. Jaws 563 are moved to the closed position when the first 52 and second 54 sections are screwed together by drawing the gripping section's threaded portion 561 into the first section's threaded portion 523, which in turn draws the distal portion 562 into the second section's bore 541, bringing the jaws 563 sufficiently close together to grip a needle 502. This is assembly is well known in the art, and is used in removable-blade knives.

A wall hanger kit of the present invention comprises a wall hanger 10,15 and a pilot tool 50 as described above.

The method of mounting the wall hanger of the present invention, as illustrated in FIGS. 6A–6D, comprises the steps of providing a wall hanger as described above, here shown as the picture hanger 10 of FIGS. 1 and 2, placing the wall hanger 10 with its first side 104 against a wall 60 and the top edge 110 facing generally upwards (FIG. 6A). Next a pilot tool 50 is pushed through at least two of the bores 118 to start holes in the wall 60 aligned with each of the selected bores 118 (FIG. 6B). Preferably the holes are sufficiently long to enable a pleating pin 70 to pass through the bores 118 and partially into the wall 60. Then a pleating pin 70 is pushed into each bore 118, into the started hole, and completely into the wall 60 using the pilot tools's indentation 526 (FIG. 6C). Finally, the hanger 902 of an object 90 is hung upon the protrusion, such as screw 120 (FIG. 6D).

The wall hanger of the present invention can easily be removed. The method comprises the steps of providing a wall hanger mounted as described above. Any thin object can be inserted beneath the bottom of the hanger and raised. The bottom 112 is then replaced against the wall 60, which leaves the pin heads 702 elevated. Next the pins 70 are pried out of wall 60 by rocking the hanger 10.

In the foregoing description, certain terms have been used for brevity, clarity, and understanding, but no unnecessary limitations are to be implied therefrom beyond the requirements of the prior are because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A hanger for mounting an object to a wall while mimimizing damage thereto, the hanger having:

a generally planar first side for interfacing with a wall;

a second side generally opposed to the first side;

a top edge and a bottom;

a plurality of narrow bores disposed adjacent the top edge, the bores extending from the second side to the first side and angling away from the top edge at an angle in a range of 20 to 30 degrees from a normal to the first side of the base, wherein each bore is dimensioned to permit a pleating pin to pass therethrough; and means for supporting an object, the supporting means protruding from the second side and positioned a first distance from the top edge and a second distance greater than the first distance from the bottom, such a positioning serving in use to translate a portion of a gravitational force exerted by the supported object into a force directed into the wall, thereby relieving a stress on pins inserted through the bores into the wall.

2. The wall hanger recited in claim 1, wherein the support means comprises a unitary protrusion having means for restraining a hanging means of an object when the hanging means has been hung upon the protrusion.

3. The wall hanger recited in claim 2, wherein the protrusion comprises a hook member having a first end integrally connected to the hanger second side and a second end having an upwardly extending portion defining a valley onto which an object may be hung and restrained by the upwardly extending portion.

4. The wall hanger recited in claim 2, wherein the protrusion comprises a screw affixed to the hanger second side and the restraining means comprises a head of the screw.

5. The wall hanger recited in claim 1, further having a second edge and a third edge, each meeting the top edge at an angle less than 90 degrees, forming along with the top edge a generally triangular shape, the bottom comprising a bottom point of the triangular shape at a junction of the second and the third edge.

6. The wall hanger recited in claim 5, wherein the top edge, the second edge, and the third edge meet at angles of approximately 60 degrees, thereby forming a generally equilateral triangular shape.

7. The wall hanger recited in claim 6, wherein the top edge, the second edge, and the third edge are beveled outward from the second side to the first side.

8. The wall hanger recited in claim 1, wherein the support means comprises means for supporting an object generally adjacent the second side.

9. The wall hanger recited in claim 1, wherein the bores are further dimensioned to permit a sewing needle to pass closely therethrough, for permitting a wall hole to be pretapped with a pilot tool having a sewing needle at a first end and a handle at a second end prior to an insertion of a pleating pin through each bore, the sewing needle having a greater stiffness than a pleating pin for facilitating piercing a surface of the wall.

10. A picture hanger for minimizing damage to a wall comprising a triangular clear plastic member having:

a generally planar first side for interfacing with a wall;

a generally planar second side opposed to the first side;

a top edge along a first edge of the triangular member;

a generally pointed bottom formed by a second edge and a third edge of the triangular member;

a plurality of narrow bores positioned along the top edge extending in a direction away from the top edge from the second side to the first side at an angle with a normal to the first side in a range of approximately 20–30 degrees, wherein each bore is sufficiently narrow and sufficiently long to permit a pleating pin to pass therethrough; and a support protrusion having a first end affixed to the base second side and an upturned portion at a second end for restraining a picture wire of a picture, the protrusion positioned a first distance from the top edge and a second distance greater than the first distance from the bottom, such a positioning serving in use to translate a portion of a gravitational force exerted by the supported object into a force directed into the wall, thereby relieving a stress on pins inserted through the bores into the wall.

11. A hanger kit for mounting an object to a wall while minimizing damage thereto comprising:

a hanger having:

a generally planar first side for interfacing with a wall;

a second side generally opposed to the first side;

a top edge and a bottom;

a plurality of narrow bores disposed adjacent the top edge at an angle in a range of 20 to 30 degrees from a normal to the first side of the base, the bores extending from the second side to the first side and angling away from the top edge, wherein each bore is dimensioned to permit a pleating pin to pass therethrough; and means for supporting an object, the supporting means protruding from the second side and positioned a first distance from the top edge and a second distance greater than the first distance from the bottom, such a positioning serving in use to translate a portion of a gravitational force exerted by the supported object into a force directed into the wall, thereby relieving a stress on pins inserted through the bores into the wall; and a pilot tool comprising:

a pointed borer for pretapping a hole in a wall after having passed through a bore of the wall hanger, the borer having a first pointed end, a second end, and a length dimensioned to make a hole in a wall sufficiently deep to house a pleating pin; and a handle affixable to the second end of the borer at a first end and having an indentation at a second end dimensioned to surround a head of a pin for pushing the pin into a pretapped hole in a wall.

12. A method for mounting an object on a wall in a fashion so as to minimize the damage done to the wall, the method comprising the steps of:

providing a wall hanger having:

a generally planar first side for interfacing with a wall;

a second side generally opposed to the first side;

a top edge and a bottom;

a plurality of narrow bores disposed adjacent the top edge at an angle in a range of 20 to 30 degrees from a normal to the first side of the base, the bores extending from the second side to the first side and angling away from the top edge, wherein each bore is dimensioned to permit a pleating pin to pass therethrough; and means for supporting an object, the supporting means protruding from the second side and positioned a first distance from the top edge and a second distance greater than the first distance from the bottom, such a positioning serving in use to translate a portion of a gravitational force exerted by the supported object into a force directed into the wall, thereby relieving a stress on pins inserted through the bores into the wall;

placing the wall hanger first side against a wall and the top edge facing generally upwards;

pushing a boring tool through at least two bores to pretap a hole in the wall aligned with each bore, the hole being sufficiently long to enable a pleating pin to pass through the bore and into the wall;

pushing a pleating pin into each pretapped bore; and mounting an object upon the support means.

* * * * *